US006993950B2

(12) United States Patent
Bryan

(10) Patent No.: US 6,993,950 B2
(45) Date of Patent: Feb. 7, 2006

(54) REBAR CUTTER AND BENDER

(76) Inventor: William Bryan, P.O. Box 1234, Yelm, WA (US) 98597

( * ) Notice: Subject to any disclaimer, the term of this patent is extended or adjusted under 35 U.S.C. 154(b) by 359 days.

(21) Appl. No.: 10/648,732

(22) Filed: Aug. 25, 2003

(65) Prior Publication Data

US 2005/0044923 A1 Mar. 3, 2005

(51) Int. Cl.
*B21D 7/02* (2006.01)

(52) U.S. Cl. ..... 72/214; 72/217; 72/294; 72/390.1; 72/389.9; 72/464

(58) Field of Classification Search ..... 72/213, 72/214, 217, 294, 384, 390.4, 389.1, 389.9, 72/464

See application file for complete search history.

(56) References Cited

U.S. PATENT DOCUMENTS

| | | | | |
|---|---|---|---|---|
| 3,299,691 A | | 1/1967 | Pahl et al. | |
| 3,847,189 A | * | 11/1974 | Guzda | 72/464 |
| 3,858,427 A | | 1/1975 | Euteneuer et al. | |
| 4,081,027 A | * | 3/1978 | Nguyen | 72/464 |
| 4,223,545 A | * | 9/1980 | Tucholski | 72/217 |
| 4,561,279 A | * | 12/1985 | Wears | 72/217 |
| 4,638,703 A | * | 1/1987 | Muhr | 72/464 |
| 4,798,078 A | * | 1/1989 | Schweitzer | 72/390.4 |
| 4,945,751 A | * | 8/1990 | Ireland | 72/384 |
| 5,144,829 A | * | 9/1992 | Fabro et al. | 72/294 |
| 5,203,192 A | * | 4/1993 | Kimura | 72/217 |
| 5,259,232 A | * | 11/1993 | Schweitzer | 72/213 |
| 5,761,950 A | * | 6/1998 | Chiu | 72/389.9 |
| 5,878,615 A | * | 3/1999 | Brown | 72/217 |

FOREIGN PATENT DOCUMENTS

| | | |
|---|---|---|
| GB | 2093749 | 8/1982 |
| SU | 1826930 A3 | 7/1993 |

* cited by examiner

*Primary Examiner*—David Jones
(74) *Attorney, Agent, or Firm*—Brian J. Coyne

(57) ABSTRACT

A portable devic for bending and cutting rebar, reinforcing rod, and the like. For cutting, a shaft assembly is movable along a first longitudinal axis (A—A) between a retracted and an extended position. A movable cutting head carried by the shaft assembly coacts with a fixed cutting head to shear rebar disposed between the cutting heads when the shaft assembly is moved to the extended position. For bending, a push rod movable along a second longitudinal axis (C—C) parallel to the first axis (A—A) couples movements of the shaft assembly through a clevis to a crankshaft such that longitudinal movements of the shaft assembly cause rotational movements of the crankshaft about an axis substantially perpendicular to axis (A—A). A first driven wheel, mounted for rotation with the crankshaft, has one or more bending blocks attached to the wheel by a radial arm. Rebar inserted in a gap between the first wheel and a second, idler wheel, is bent by the bending blocks as the wheels rotate in response to movement of the shaft assembly from a retracted to an extended position.

12 Claims, 16 Drawing Sheets

REBAR CUTTER AND BENDER

CROSS REFERENCE TO RELATED APPLICATIONS

None.

STATEMENT REGARDING FEDERALLY APPROVED RESEARCH OR DEVELOPMENT

Not applicable.

BACKGROUND OF THE INVENTION

1. Field of the Invention

This invention relates generally to devices for cutting and bending a workpiece such as rebar, reinforcing rod, and the like, and in particular to those that are sufficiently compact and portable as to be easily transported to building construction sites.

2. Background Art

A variety of lengths and configurations of rebar or reinforcing rods must be embedded within concrete structures when creating concrete foundations, walls, floors, columns, and other concrete building components. This requires shearing the rebar into pieces of the required dimensions and, in some cases, for example, when erecting concrete columns, further requires bending the sheared pieces through one or more bends. Bend angles may vary from 0 to 360 degrees. Although relatively large, non-portable devices exist by which fabricators can make the required cuts and bends, it is desirable to be able to use a portable device at the construction site to make the required cuts and bends. The present invention fulfills that need.

Brown, U.S. Pat. No. 5,878,615, disclosed portable apparatus for bending and cutting a workpiece. A workpiece was held stationary by a bending pin actuated by a hydraulic cylinder that clamped the workpiece to a support plate. A second hydraulic cylinder lifted a movable bending member toward the workpiece, bending the workpiece about the bending pin in the process. A fixed cutting member and a movable cutting member in side to side abutment were provided. A workpiece inserted through aligned slots in the fixed and movable bending members would be sheared when the slots were moved out of alignment by a hydraulic cylinder.

Ireland, U.S. Pat. No. 4,945,751, disclosed a portable reinforcing rod cutter and bender. For cutting, a workpiece was inserted transversely through an aperture in a stationary cutting die, and a longitudinally-movable cutting shear blade actuated by a hydraulic cylinder sheared the workpiece. For bending, a workpiece was inserted transversely between a stationary die block and a longitudinally movable anvil actuated by a hydraulic cylinder; the die block had a concave, arcuate recess and the anvil had, in mating opposition thereto, a convex, arcuate surface such that advancement of the anvil toward the die block cause the workpiece to bend.

The devices of Brown and Ireland had limited ability, however, to create multiple bends in a workpiece such as rebar and they provide no convenient means for doing so. Ireland's device required a multiplicity of die block's of varying sizes, for instance, in order to create bends of different radii, requiring attaching and detaching selected die blocks each time a new bend radius was required. A need remains, therefore, for a portable device that is capable of not only cutting rebar but also of making multiple bends of up to 360 degrees each in a piece of rebar.

SUMMARY OF THE INVENTION

Accordingly, it is an object of the invention to provide a device that will cut a workpiece such as rebar, reinforcing rod, and the like.

It is a further object that the device be capable of bending a workpiece through an angle of zero to 360 degrees.

A further object of the invention is that the device be capable of making multiple bends in a workpiece of varying bend radii without requiring any significant time delay to remove and replace component parts of the device.

Another object of the invention is that the device be compact and portable.

These and other objects of the invention are achieved by providing a device with a shaft assembly connected to a longitudinally-extended main frame. The shaft assembly is movable along a first, longitudinal axis (A—A) between a first, retracted position and a second extended position. A first, movable cutting head is carried by the shaft assembly and is movable therewith along axis (A—A). A second, fixed cutting head is disposed such that the first cutting head is substantially adjacent to the second cutting head when the shaft assembly is in the extended position. Linear actuator means, such as a double acting, single rod, hydraulic cylinder, is attached to the main frame and is in driving engagement with the shaft assembly for reciprocal movement of the shaft assembly along axis (A—A) between the retracted and extended positions. In a first mode of operation of the device, with the shaft assembly in the retracted position, the workpiece is placed laterally between the first and second cutting heads and the linear actuator means is energized to move the first cutting head against and through the workpiece, thereby cutting it in two. The linear actuator means is then energized to retract the shaft assembly and first cutting head to a retracted position, ready for the next cut.

The device further includes components for bending a workpiece. A crankshaft assembly is disposed for pivotal rotation about a first rebar bending axis (B—B) substantially perpendicular to the first longitudinal axis (A—A) in response to longitudinal movements of the shaft assembly. Means attached to the shaft assembly is provided for coupling the shaft assembly to the crankshaft assembly. A first, driven rebar bending wheel is mounted on the crankshaft assembly for rotation about the first rebar bending axis (B—B). A second, idler rebar bending wheel is longitudinally spaced-apart from the first wheel and rotatable about a second rebar bending axis (B'—B') that is parallel to the first rebar bending axis (B—B). The space between the first and second wheels defines a gap that is wide enough for insertion of a piece of rebar that is to be bended but narrow enough that the peripheral edges of the first and second wheels will be in frictional engagement with the inserted rebar. A first bending block is attached to, and rotatable with, the first wheel for bending into a first arc a piece of rebar inserted between the first and second wheels; with the shaft assembly in the retracted position, said piece of rebar is fed laterally through the gap, engaged by the first bending block, and bent in the direction of rotation of the first wheel to form a first arc. There is optionally provided, a second die block attached to and rotatable with, the first wheel and circumferentially spaced-apart therefrom, for bending a piece of rebar into a second arc. Thus, a single lateral feed of a piece of rebar between the first and second wheels can impart either a single bend or two bends therein.

In a preferred embodiment, the shaft assembly includes a shaft having a first end and a second, opposite end, said first end being attached to the rod of the hydraulic cylinder. A cutting head carriage is attached to the second end of the shaft and carries the first cutting head. Guide means disposed on opposite sides of, and in sliding engagement with, the carriage prevent lateral motion of the shaft assembly. The means for coupling the shaft to the assembly includes a push rod disposed for movement along a second longitudinal axis (C—C) substantially parallel to the first longitudinal axis (A—A). The push rod has a first end attached to the carriage and an opposite, apertured, second end. The second end of the push rod is pivotally attached to a clevis. A longitudinally-disposed link has a first, apertured end inserted between the ears of the clevis and an opposite, second end pivotally attached to the crankshaft assembly. A clevis pin is inserted through apertures in the clevis ears and through the aperture in the second end of the push rod. Thus, longitudinal movements of the shaft assembly cause pivotal movements of the crankshaft assembly and, consequently, pivotal movements of the first, driven rebar wheel.

The crankshaft assembly preferably includes a crankshaft aligned on the first longitudinal axis (A—A). The crankshaft has an upper, relatively small diameter, cylindrical portion and a lower, relatively large diameter, cylindrical portion that is coaxial with the upper portion, such that the junction of the upper and lower portions defines a shoulder. A crank is provided having a first, upper end and a second lower end joined by an intermediate neck portion, said upper end of said crank being attached to, and eccentrically-disposed with respect to, the lower portion of the crankshaft. A crankshaft support leg is coaxial with and extends away from the crankshaft, and is attached to the second end of the crank. Means is provided for attaching the crank to the crankshaft; preferably, said means includes a first crankshaft pin that is press fitted through a first set of aligned apertures in an upper end of the crank and in the lower end of the crankshaft, and a second crankshaft pin that is press fitted through a second set of aligned apertures in the crank and in the crankshaft support leg; said means further includes plug welds in the first and second set of aligned apertures and welds attaching the crank to the crankshaft and to the leg.

The main frame includes two laterally spaced-apart vertical sides, each side having a first end and an opposite, second end, and a rebar receiving slot intermediate the first and second ends. The main frame further includes a laterally-disposed cylinder head having a first longitudinally-directed cylinder head bore through which the shaft reciprocates, said cylinder head joining the first ends of said sides. A laterally-disposed bulkhead intermediate the second ends and the rebar-receiving slot also joins said sides and has a longitudinally-directed bulkhead bore through which the push rod reciprocates. The main frame further first and second wheel blocks for support of pivotal rotation of the firsst and second wheels, respectively, and further includes a horizontal top plate that joins upper portions of the sides and extends from the second ends thereof towards the bulkhead. The main frame preferably further includes a bottom plate that joins and extends between lower portions of the sides of the main frame. The crankshaft support leg rests on a crankshaft bearing mount disposed on an upper surface of the bottom plate and is journalled for rotation within a bearing formed within the first wheel block. Preferably, a rebar measuring gauge attached to the main frame is also provided for measuring off the desired length of rebar to be cut.

Figure 5:
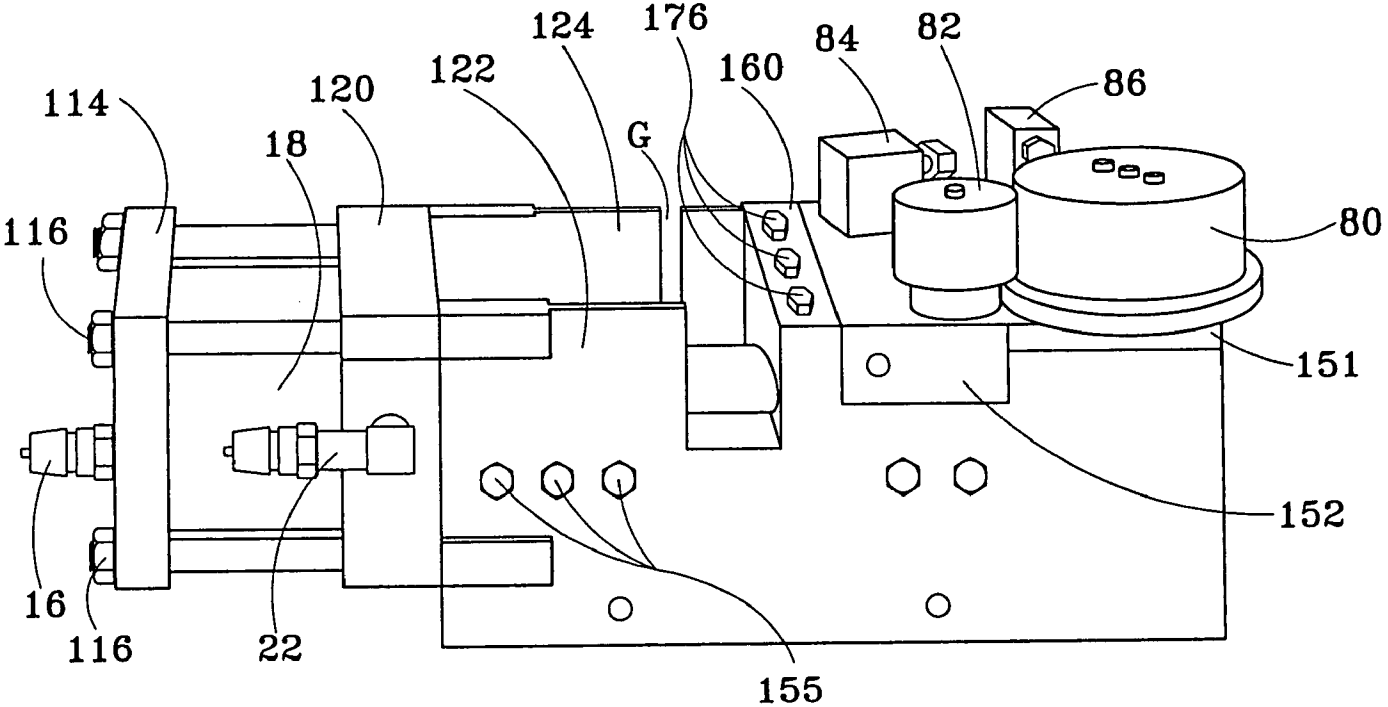
FIG. 5 is a frontal perspective view of the device.
Figure 6:
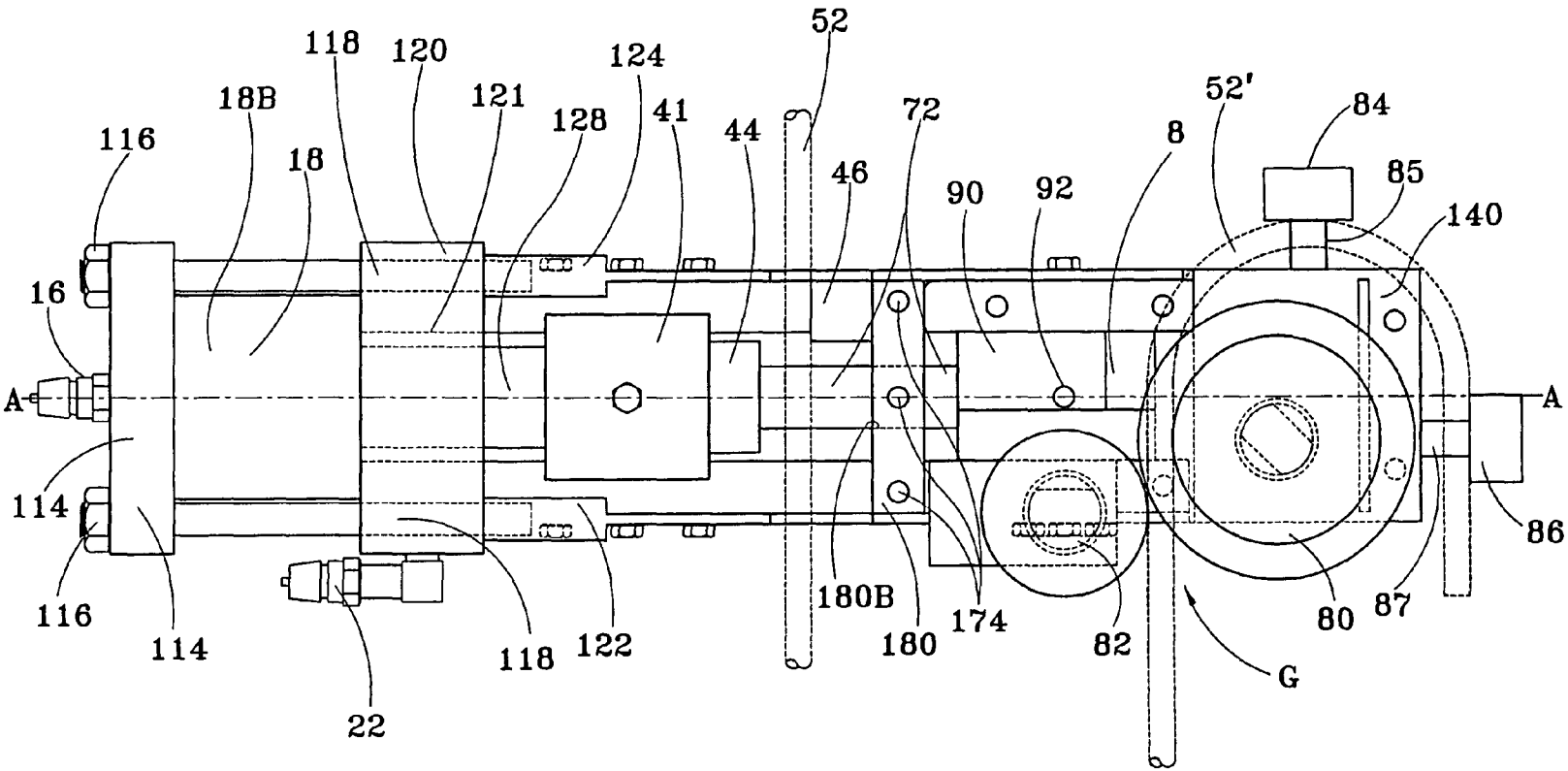
FIG. 6 is a top plan view thereof with the hydraulic source, hydraulic lines and top plate removed, with the shaft assembly thereof in a retracted position and showing internal components in phanotom outline.
Figure 7:
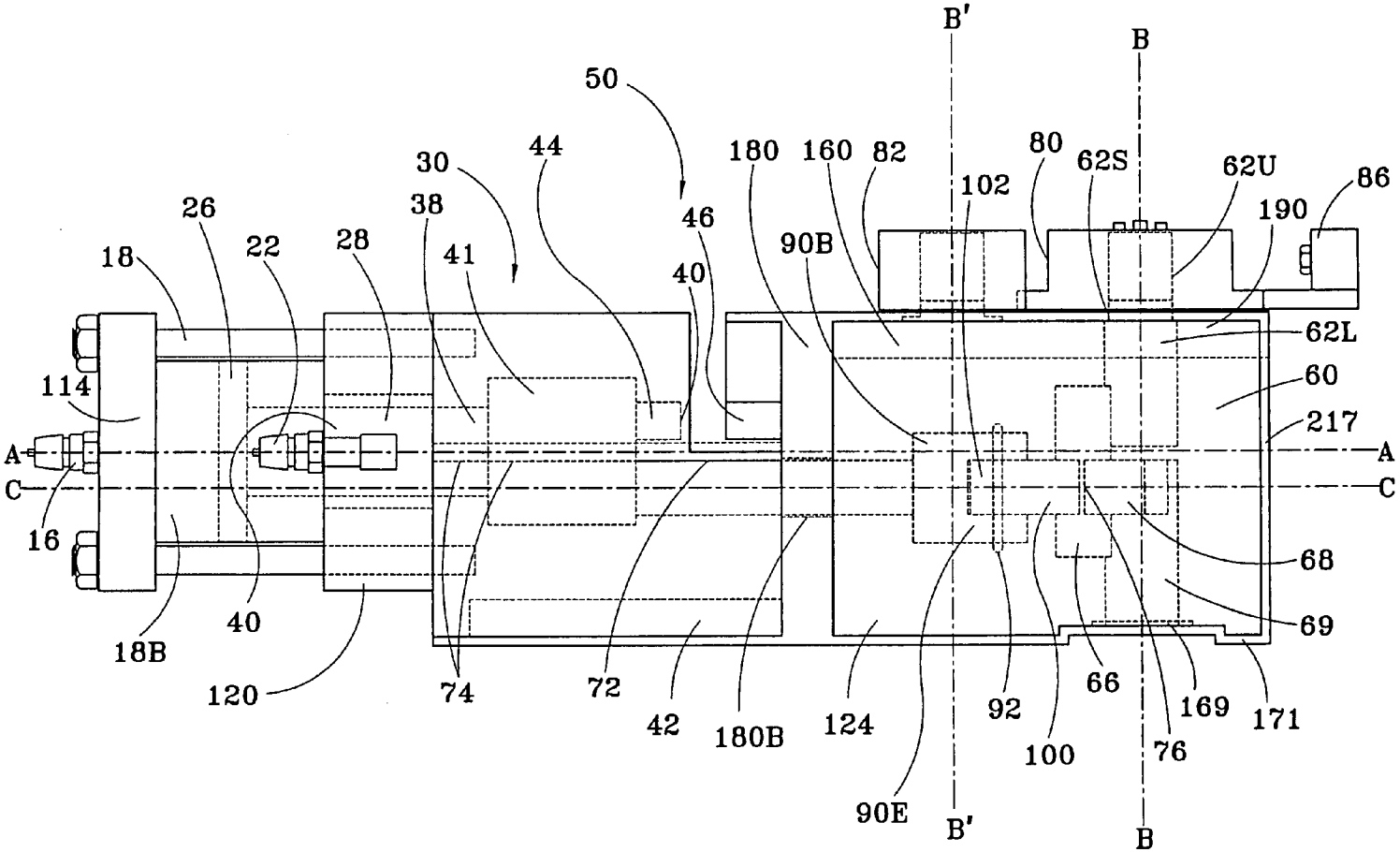
FIG. 7 is a front elevational view thereof.
Figure 8:
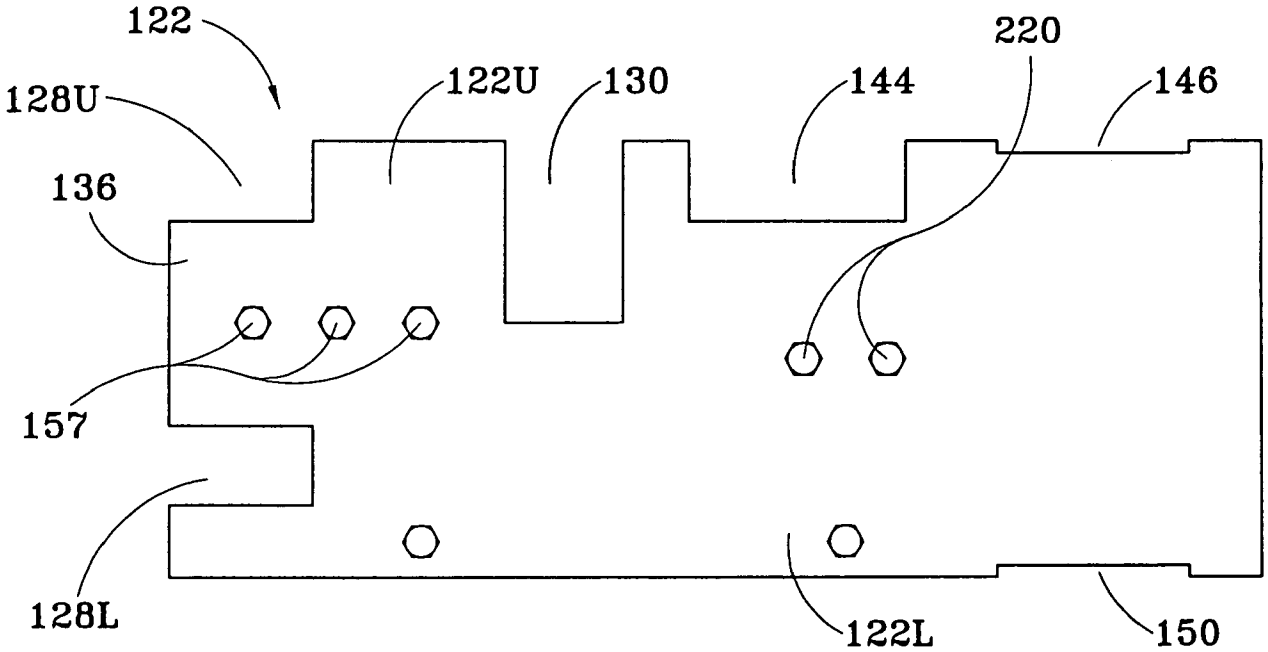
FIG. 8 is a front elevational view of the front side thereof removed from the device.
Figure 9:
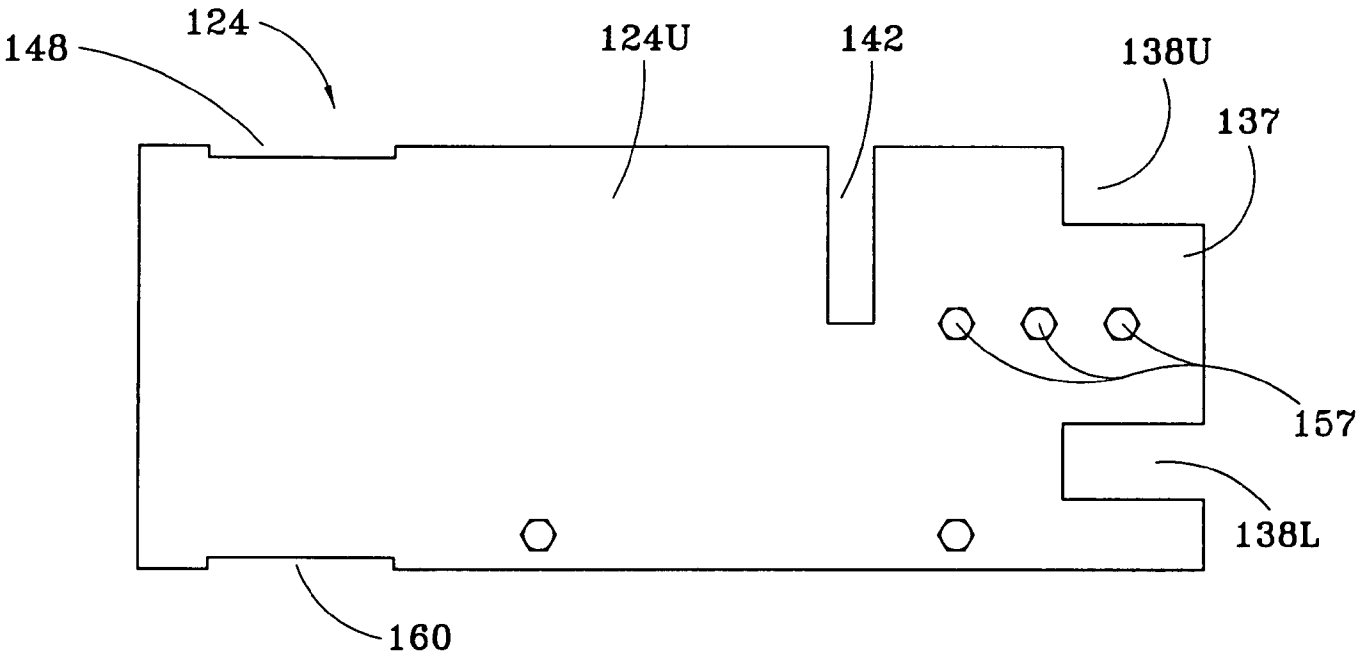
FIG. 9 is a rear elevational view of the rear side thereof removed from the device.
Figure 10:
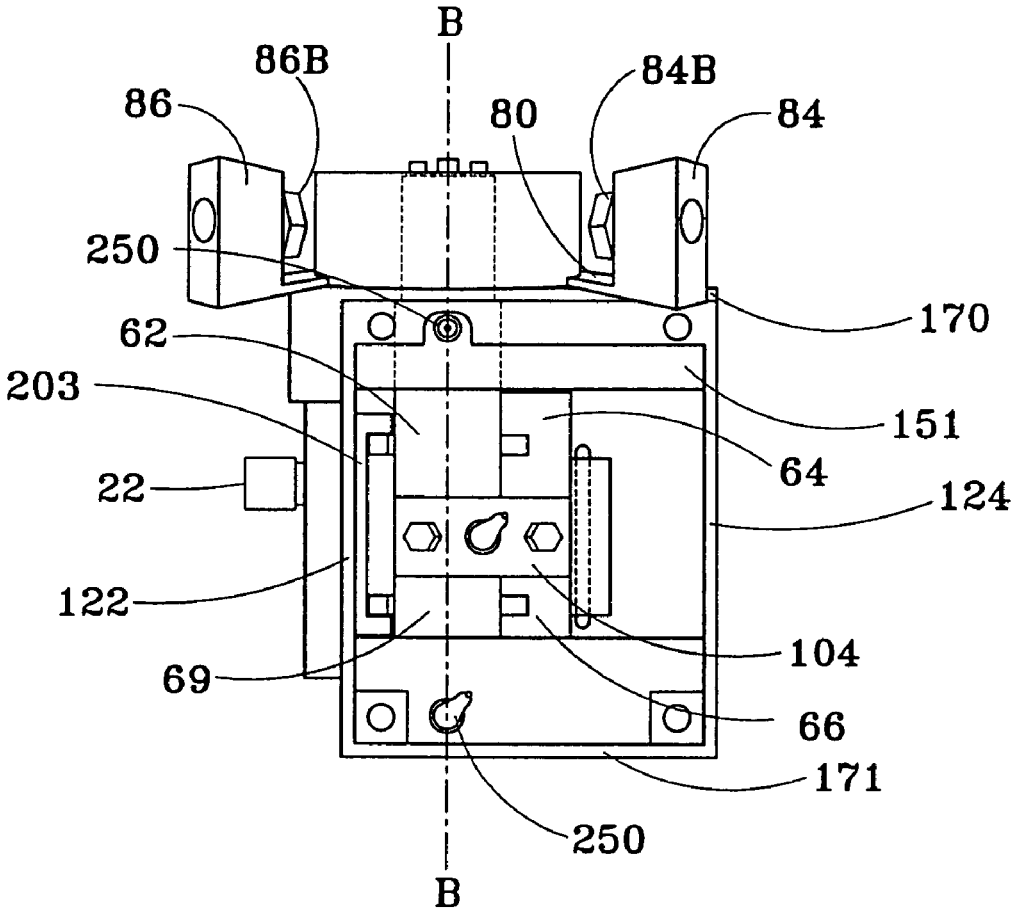
FIG. 10 is an elevational view of the right end thereof with the right end cover plate removed.

The designations "left" and "right" refer to the orientation of the device as depicted in FIGS. 5, 6 and 7.

DETAILED DESCRIPTION OF THE PREFERRED EMBODIMENT

Figure 1:
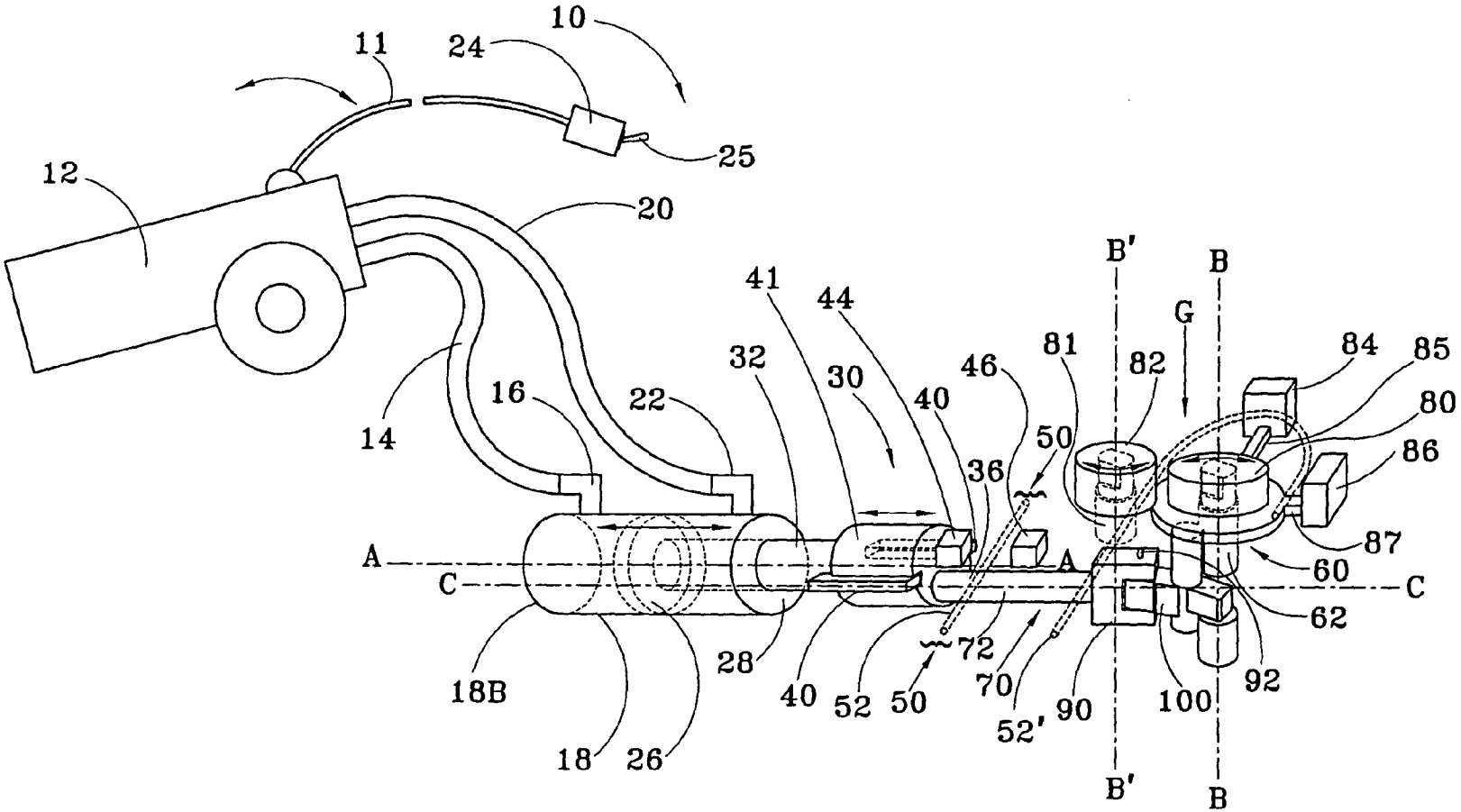
FIG. 1 is a schematic illustration of a preferred embodiment of the device of the present invention in perspective view.

Referring now to FIG. 1, a preferred embodiment of the invention, denoted generally by the numeral 10, is depicted schematically, with the main frame and certain other components omitted for the sake of simplicity. It may be seen that a hydraulic power source 12 is connected by a first hydraulic line 14 to a first inlet port 16 near the blind end 18B of a double-acting, single rod, hydraulic cylinder 18; the source 12 is connected to a second inlet port 22 on an opposite end of the hydraulic cylinder 18 by a second hydraulic line 20. Hydraulic valve control means 24 connected to the source 12 by a cable 11 selectively directs, through operator control of a three-position switch 25, pressurized hydraulic fluid from the source 12 either through line 14 to advance the piston 26 and the piston rod 28 longitudinally along axis (A—A) or through line 20 to retract them. The hydraulic power source 12 preferably should be able to provide at least 2,300 pounds per square inch huydraulic pressure and 11 gallons of fluid per minute; the power source 12 also should be equipped with quick connect fittings for attachment to the inlet ports 16, 22.

A shaft assembly, denoted generally by the numeral 30, has a first end 32 attached to the piston rod 28 and an opposite, second end 34. The shaft assembly 30 is movable along axis (A—A) between a first, retracted position and a second, extended position in response to movements of the piston 26 and rod 28. The shaft assembly 30 includes a shaft 36 having a first end 38 and a second, opposite end 40, said first end 38 being attached to the piston rod 28, a cutting head carriage 41 attached to the second end of the shaft, and longitudinally-extended, fixed guide means 42 disposed on opposite sides of the carriage 41 for maintaining linear travel of the carriage 41 along axis (A—A) as the carriage 41 slides by. As may be seen in FIGS. 11 and 16, the shaft 36 has external threads that are received by a longitudinally-directed, internally threaded bore 41B in the carriage 41.

The carriage 41 carries a first cutting head 44 disposed for travel along axis (A—A). The first cutting head 44 is removably mounted to the carriage 41 and extends longitudinally away from the cylinder 18 and toward a rebar cutting region, denoted generally by the numeral 50. A second, fixed cutting head 46 is disposed within the cutting region 50 such that the first cutting head 44 is substantially adjacent to the second cutting head 46 when the shaft assembly 30 is in an extended position. Thus, with the shaft assembly 30 in a retracted position, a workpiece, such as rebar 52, placed laterally across the cutting region 50 between the first cutting head 44 and the second cutting head 46, will be sheared by the coaction of the first, movable cutting head and the second, fixed cutting head 46, the latter serving to hold the rebar 52 fast against the advancing force of the movable cutting head 44.

Figure 2:
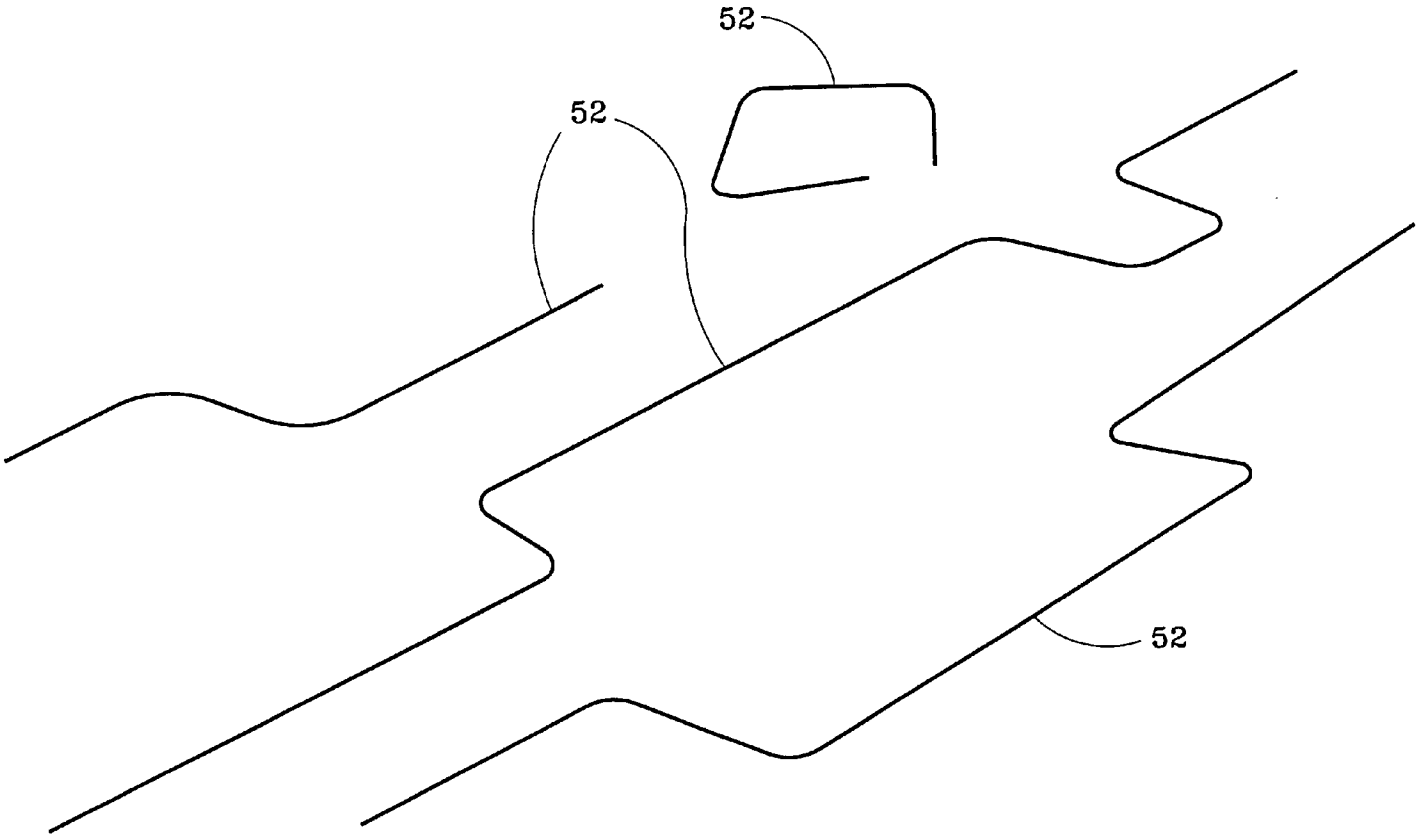
FIG. 2 illustrative of the utility of the device for bending rebar, depicts in perspective view four pieces of rebar that have been bent by the present invention.

For bending a workpiece such as rebar 52', the invention further includes a crankshaft assembly, denoted generally by the numeral 60, disposed for pivotal rotation about a first, rebar bending axis (B—B) substantially perpendicular to the first longitudinal axis (A—A) in response to longitudinal movements of the shaft assembly 30. Means 70 attached to the shaft assembly 30 couples the shaft assembly 30 to the crankshaft assembly 60 such that reciprocal movements of the shaft assembly 30 along axis (A—A) cause pivotal movements of the crankshaft assembly 60 about axis (B—B). The crankshaft assembly 60 carries a first, driven rebar bending wheel 80, which pivots with the crankshaft assembly 60 about axis (B—B). A second, idler rebar bending wheel 82 is longitudinally spaced-apart from the first wheel 80 and is rotatable on an idler shaft 81 about a second rebar bending axis (B'—B') that is parallel to the first rebar bending axis (B—B). The space between the first and second wheels defines a gap G that is wide enough for insertion of a piece of rebar 52' that is to be bended, but narrow enough that the peripheral edges of the first wheel 80 and the second wheel 82 will be in frictional engagement with the inserted rebar 52'. To accommodate rebar 52' of various widths, idler wheels 82 of differing diameters may be removably attached to, and disattached from, the device 10 in order to create a gap G of suitable width. A first bending block 84 is attached by a first radial arm 85 to the first wheel 80 for rotation therewith, such that rebar 52' is bent by rotation of the first bending block 84 through a first arc of up to 180 degrees. Preferably, a second bending block 86 is attached by a second radial arm 87 to the first wheel 80, and is rotatable therewith and circumferentially spaced-apart from the first bending block 84, for bending into a second arc of up to 180 degrees a piece of rebar 52' inserted laterally between the first wheel 80 and the second wheel 82. Each bending block 84, 86 carries a threaded adjustment bolt 84B, 86B within a threaded bore for adjusting the amount of bending to imparted to a revar work piece per degree of rotation of the first wheel 82. By sequentially bending the rebar 52' through a first arc of 180 degrees immediately followed by bending the same rebar 52' through a second arc of 180 degrees, a 360 degree bend can be achieved. Virtually any sequence of bends may be imparted to rebar 52' to fulfill a variety of construction site needs; see, for example, the sequence of bends imparted to rebar as depicted in FIG. 2.

Figure 3:
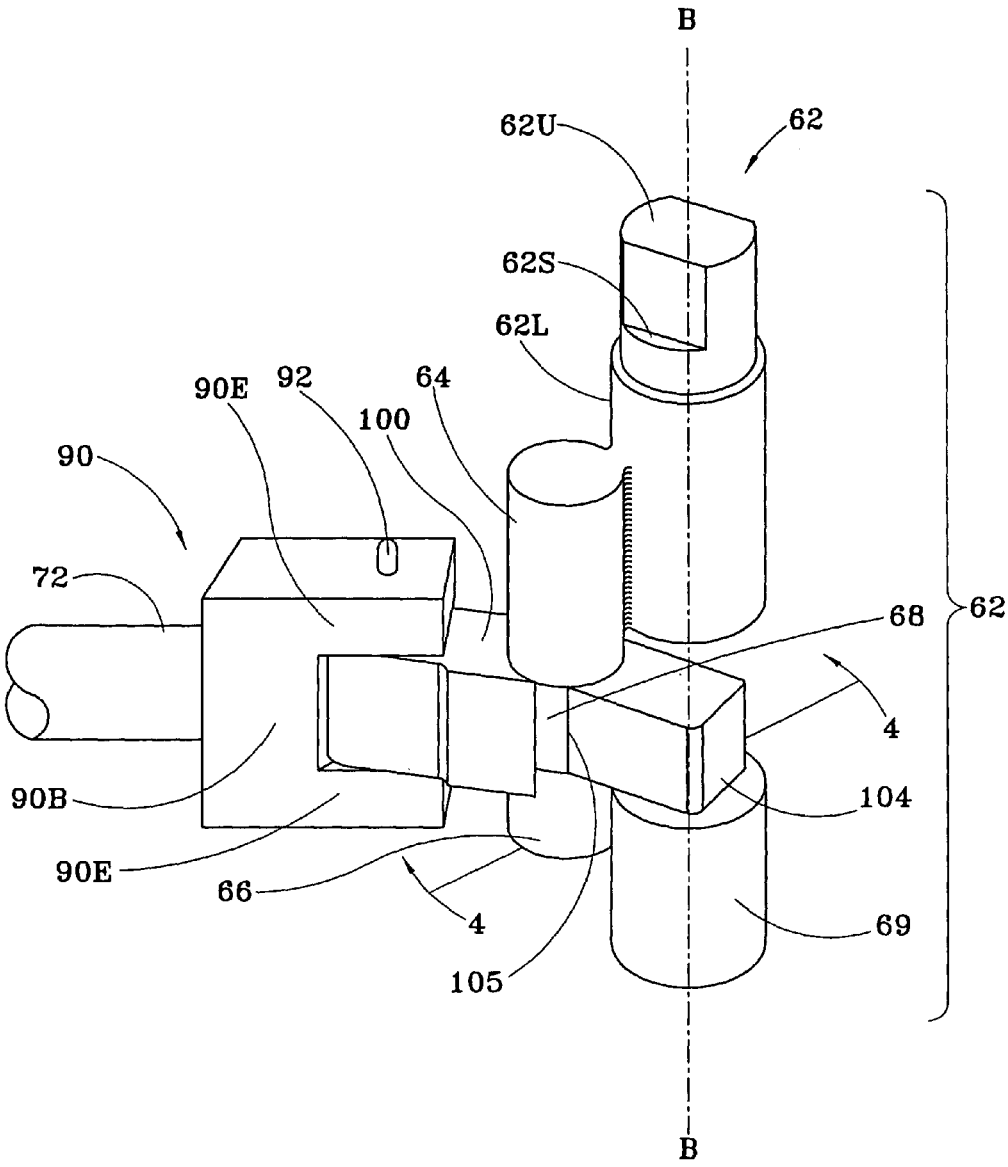
FIG. 3 is an enlarged, front side perspective view of the crankshaft assembly and the means for coupling the crankshaft assembly to the shaft assembly.
Figure 4:
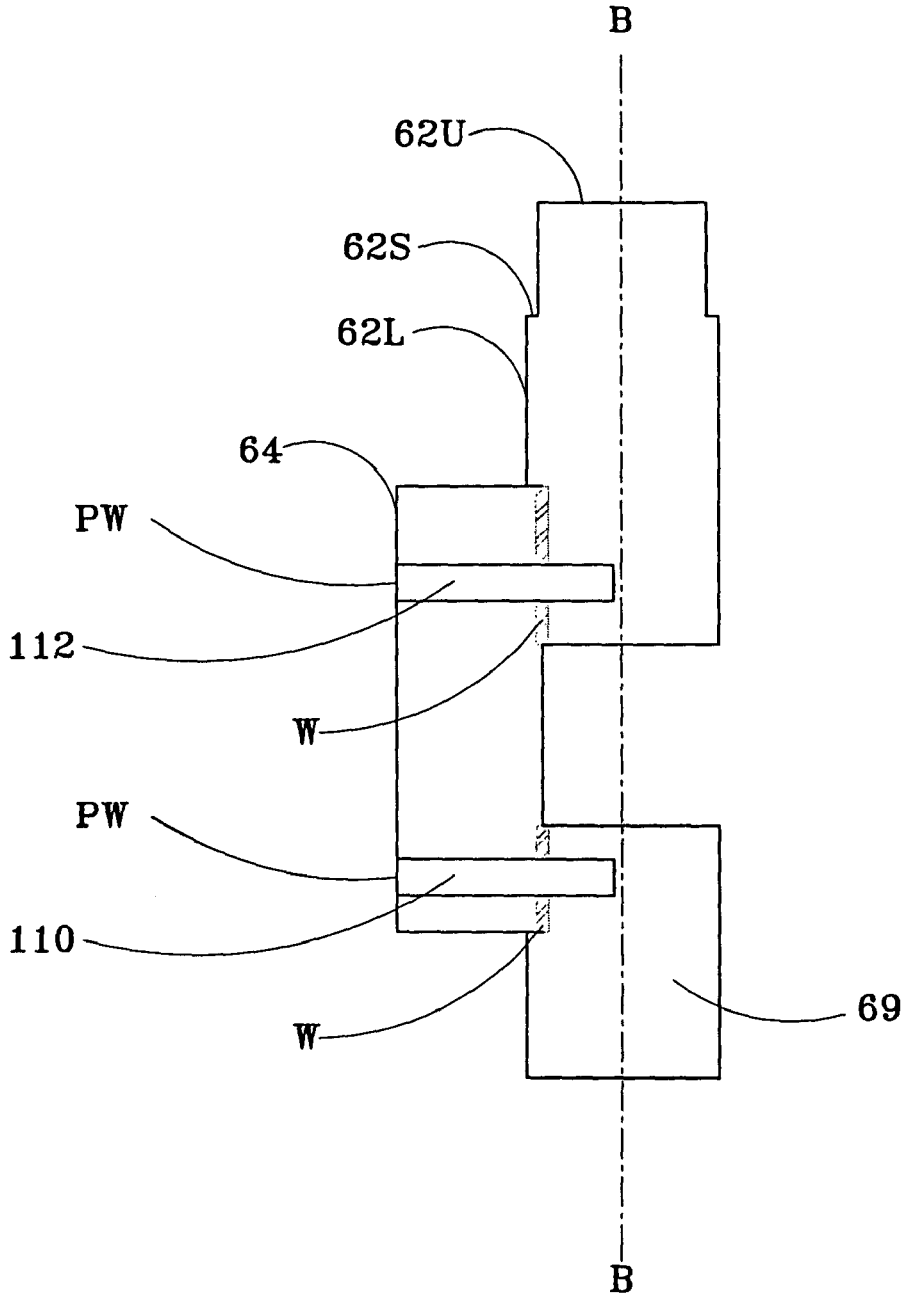
FIG. 4 is a cross-sectional view of a crank assembly taken along line 4—4 of FIG. 3.
Figure 16:
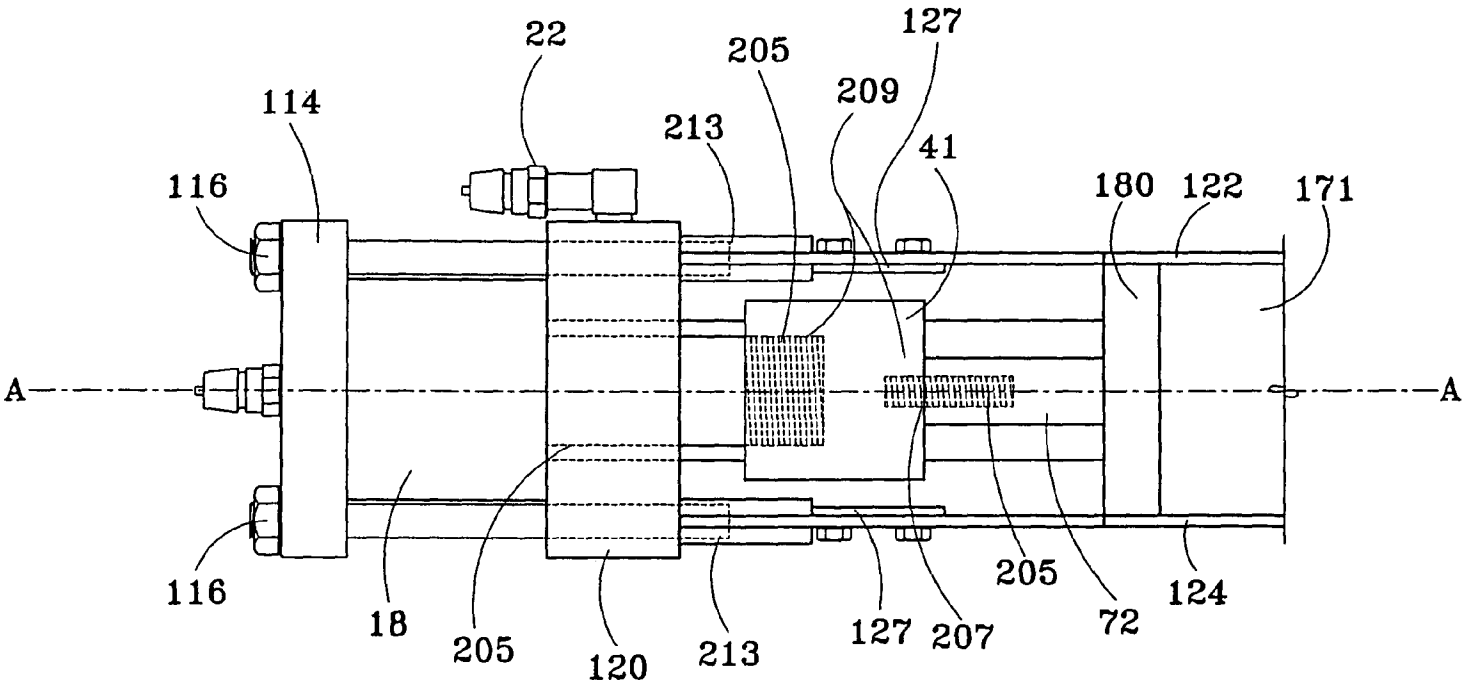
FIG. 16 depicts the bottom of the device in plan view, showing in phantom outline the manner of attachment of the shaft to the carriage and of the shaft to the push rod.

In a preferred embodiment, as may best be seen in FIG. 3, the means 70 for coupling the shaft assembly 30 to the crankshaft assembly 60 includes a push rod 72 disposed for movement along a second longitudinal axis (C—C) substantially parallel to and below the first longitudinal axis (A—A). The push rod 72 has a first end 74 attached to the carriage 41 and an opposite, apertured, second end 76. As shown in FIG. 16, the push rod 72 is attached to the carriage 41 by a longitudinally-directed bolt 205 that has a first end received within a first threaded bore 207 in the carriage 41 and a second end that is received within a second threaded bore 209 in the push rod 72.

Said coupling means 70 further includes a clevis 90 having two longitudinally-directed, laterally spaced-apart, apertured ears 90E joined by a laterally-disposed base 90B, which base 90B has a longitudinal bore that receives the second end of the push rod 72. Said means 72 also includes a longitudinally-disposed link 100 having a first, apertured end 102 inserted between the ears 90E of the clevis 90 and a second, opposite end 104 pivotally attached to the crankshaft assembly 60. A clevis pin 92 is inserted through apertures in the clevis ears 90E and through the aperture in the second end of the pushrod 72.

Figure 15:
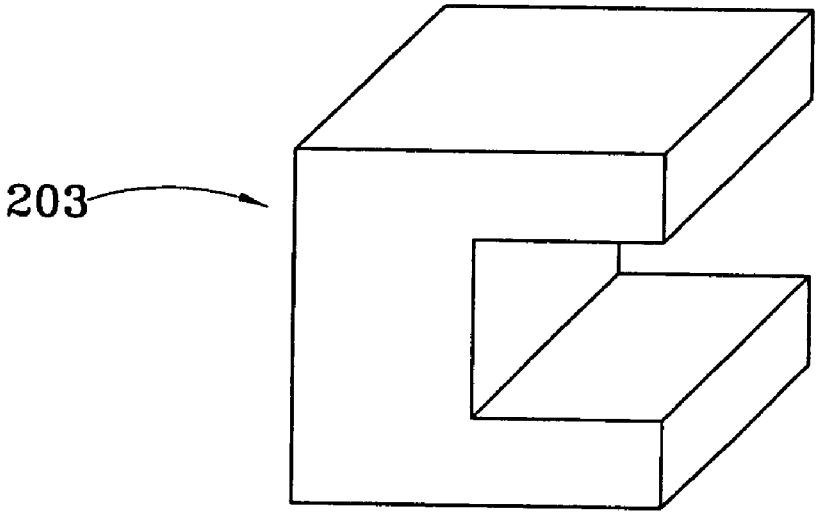
FIG. 15 is a right end perspective view of the link guide of the device.

With reference to FIGS. 1, 3, 4, and 10, the crankshaft assembly 60 includes a crankshaft, denoted generally by the numeral 62, having an upper, relatively small diameter, cylindrical portion 62U and a lower, relatively large diameter, cylindrical portion 62L coaxial with the upper portion 62U, the junction of said upper and lower portions defining a shoulder 62S. Said crankshaft assembly 60 further includes a crank 62C having a first, upper end 64 and a second, lower end 66 joined by an intermediate neck portion 68. The upper end 64 of the crank 62C is attached to, and eccentrically-disposed with respect to, the lower portion 62U of the crankshaft 62. A crankshaft support leg 69 is coaxial with and extends away from the crankshaft 62, and is attached to the second end 66 of the crank 62C. Means 120 is provided for attaching the crank 62C to the crankshaft 62, and means 130 is provided for attaching the crank 62C to the crankshaft leg 69. Said means 120 includes a first crankshaft pin 110 that is press fitted through a first set of aligned apertures in an upper end 64 of the crank 62C and in the lower end 62L of the crankshaft 62; said means 130 includes a second crankshaft pin 112 that is press fitted through a second set of aligned apertures in the crank 62C and in the crankshaft support leg 69. Said means 120 and 130 further include plug welds PW in the first and second set of aligned apertures and welds W attaching the crank 62C to the crankshaft 62 and to the leg 69. The neck portion 68 of the crank 62C is inserted through an opening 105 in the second end 104 of the link 100. All portions of the crank assembly 60 are preferably made of 86L20 steel, which may be carburized for strength. As may be seen in FIGS. 10 and 15, a C-shaped link guide 203 is attached to an inner surface of th front side 122. The link guide 203 defines an opening through which the crank reciprocates and absorbs lateral force thereform during each power stroke of the piston 26 and shaft assembly 30.

Referring now to FIGS. 6–9, abutting the blind end 18B of the cylinder 18 is a cylinder retaining plate 114 having four apertures through which are inserted four, seven and one-half inch long, longitudinally-directed bolts 116 that are received in threaded bores 118 in a cylinder head 120 disposed on an opposite end of the cylinder 18 and in threaded nuts 213 welded to exterior surfaces of the sides 122, 124, whereby the cylinder 18 is held fast between the cylinder retaining plate 114 and the cylinder head 120. The cylinder head 120 has a centrally-disposed opening 121 through which the piston rod 28 extends toward the shaft 38. The first inlet port 16 is mounted on the cylinder retaining plate 114 and communicates through an aperture therein (not shown) with the blind end 18B interior of the cylinder 18. The second inlet port 22 is mounted on the cylinder head and communicates through an aperture therein (not shown) with the piston rod interior end of the cylinder 18.

A front side 122 and a rear side 124 extend longitudinally away from opposite sides of the cylinder head 120 and extend underneath the first and second wheels 80, 82. A first end 126 of the front side 122 has a lower cutout 128L which receives a lower, longitudinally-directed extension 120FL of a lower, frontal portion of the cylinder head 120 and a cutout 128U that receives an upper, longitudinally-directed extension 120FU from an upper, rear portion of the cylinder head 120. Similarly, a first end 137 of the rear side 124 has a cutout 138L that receives a lower, longitudinally-directed extension of a rear portion of the cylinder head 120 and a cutout 138U that receives an upper, longitudinally-directed extension of a rear portion of the cylinder head 120. An upper portion 122U of the front side 122 has a cutout 132 in the rebar cutting region 50, a cutout 134 adjacent the second wheel 82, and a cutout 136 adjacent the first wheel 80. An upper portion 140U of the rear side 124 has a cutout 142 in the rebar cutting region 50 and a cutout adjacent the first wheel 80. The upper portion 136 of the front side 122 has a cutout 144 adjacent the second wheel 80 and a cutout 146 adjacent the first wheel 80. An upper portion 124U of the rear side 124 has a cutout 148 adjacent the first wheel 80. A lower portion 122L of the front side 122 has a cutout 150 adjacent the crankshaft support leg 69; similarly, the rear side 124 has a cutout 152 adjacent the leg 69. A first horizontal, laterally-disposed, wheel block 151 is received within cutouts 146, 148 and joins the front and rear sides 122, 124. A second horizontal, laterally-disposed wheel block 152 is received within cutout 144. The first wheel block 151 has an opening through which extends the crankshaft 62. The second wheel block has an opening through which extends an idler wheel shaft 160 to which is mounted the second wheel 82. A horizontal top plate 190 rests on upper portions of the 122U, 124U of the front side 122 and the rear side 124, respectively, and extends under the first wheel 80 and second wheel 82 to the rebar cutting region 50. A laterally-disposed cover plate 217 is removably attached to the second ends of the front and read sides 122, 124 by screws, which facilitates access to grease fittings 250 for lubricating upper and lower ends of the crankshaft assembly 60.

Figure 11:
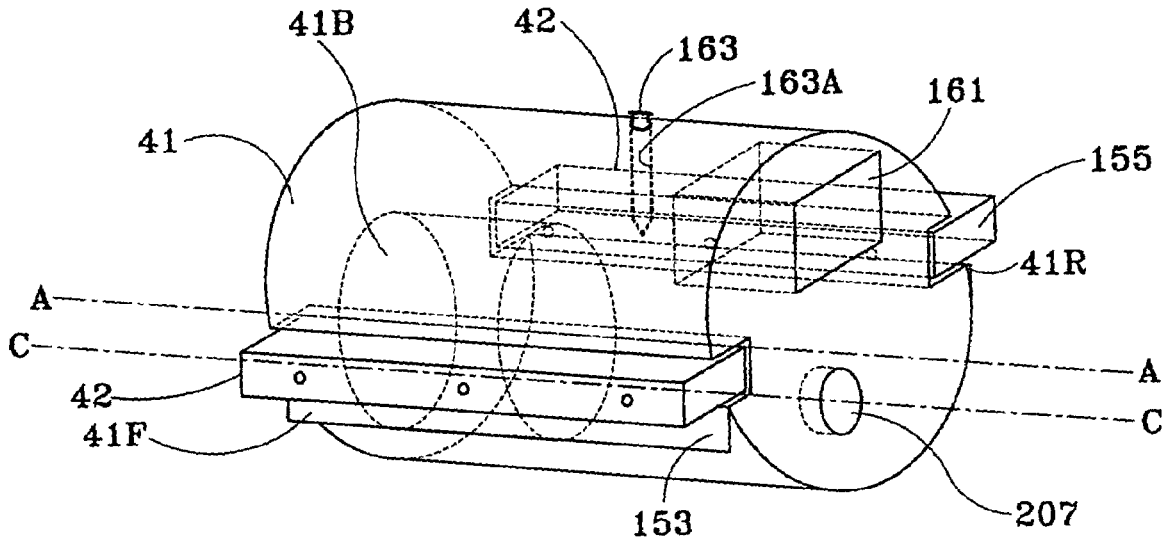
FIG. 11 is an enlarged, perspective view of the carriage and the guides removed from the device.

As may be seen in FIG. 11, a front surface 41F of the carriage and a rear surface 41R each have a longitudinal slot 159 that each receives a guide means 42; said guide means 42 have threaded apertures for receiving bolts 155 inserted through holes 157 in the front side 122 and the rear side 124, whereby the guide means 42 are fixed to the sides 122, 124 and the carriage 41 is slidable along and supported by the guide means 42. The carriage 41 has a recess 161 for receiving the first, movable cutting head 44 and a set screw within a threaded aperture 163A for retaining said head 44 within said recess 161.

The crankshaft support leg 69 rests within a seat 169 formed in a lower crankshaft support block 159 that is received within cutouts 150 and 160 and extends transversely between the front side 122 and the rear side 124. A bottom plate 171 extends between lower portions of the front side 122 and rear side 124 to which the bottom plate 171 is welded, and the bottom plate 171 extends underneath the lower crankshaft support block 159.

A bulkhead 180 is laterally disposed between, and welded to, the front side 122 (between cutouts 130 and 144), and to the rear side 124. The bulkhead 180 has a central bore 180B through which extends the pushrod 72. The fixed cutting head 46 is mounted on the bulkhead 180 for cutting coaction by the movable cutting head 44 in the cutting region 50 when rebar 52 is placed within cutouts 130 and 142. A top surface of the bulkhead 170 has three spaced-apart, threaded apertures 174 for receiving bolts 176 that secure the top plate 190 to the device.

Since large forces are generated during use of the device, the components of the frame, such as the sides 122, 124, the bottom plate 171 and the top plate 190 are preferably T1 plate steel. The remainder of the components of the device are preferably fabricated from 86L20 steel. The frame is reinforced by gussets 127 along the inside surfaces of the front side 122 and the rear side 124.

Figure 12:
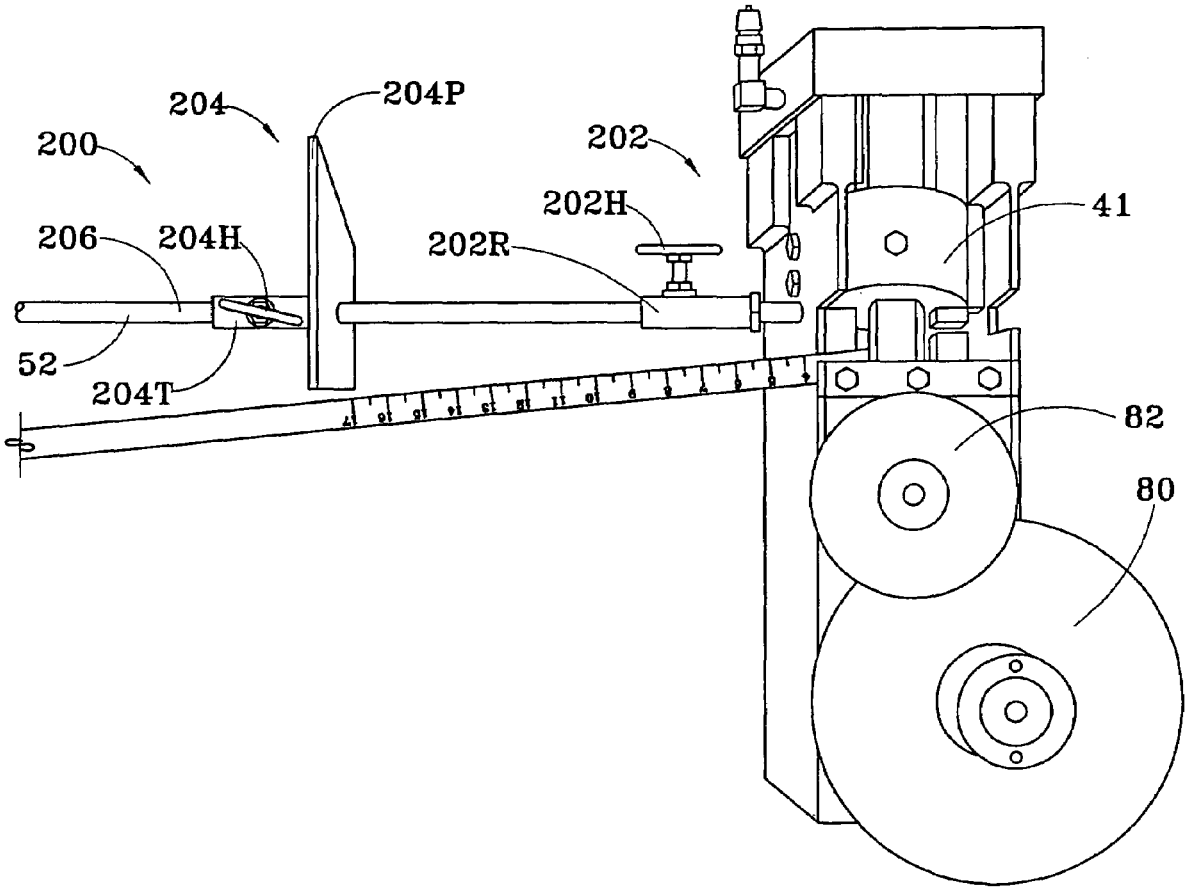
FIG. 12 is a top, perspective, partial view of the device, showing a rebar measuring gauge being used to measure off a desired length of rebar to be cut.
Figure 13:
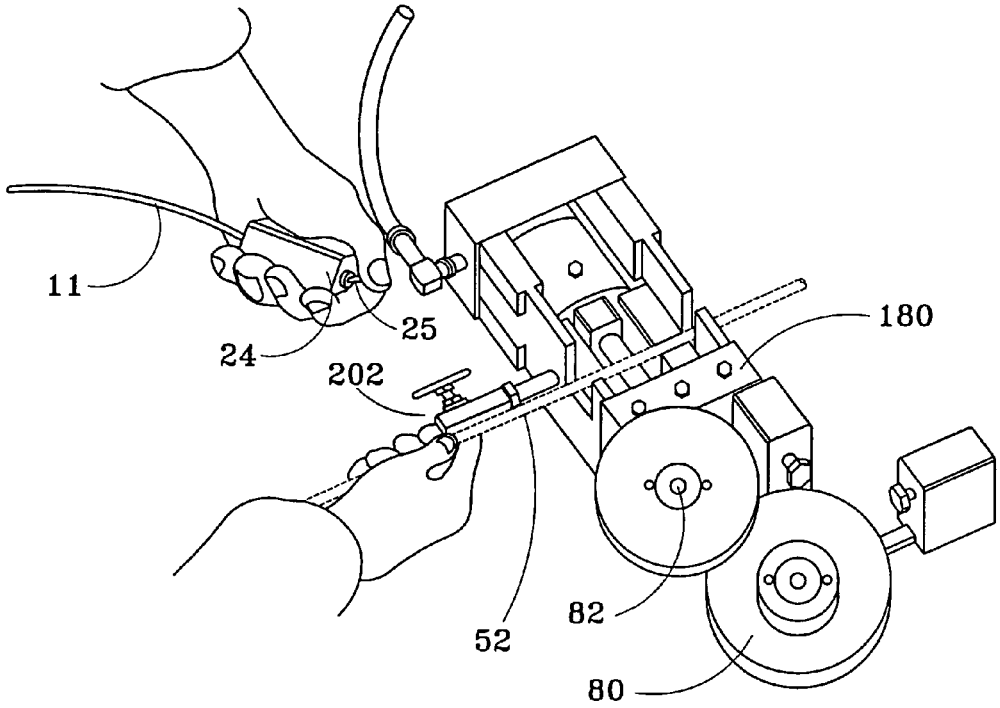
FIG. 13 is a top, perspective, partial view of the device, showing the rebar measuring gauge plate flush against the front side of the device, ready for cutting the rebar.
Figure 14:
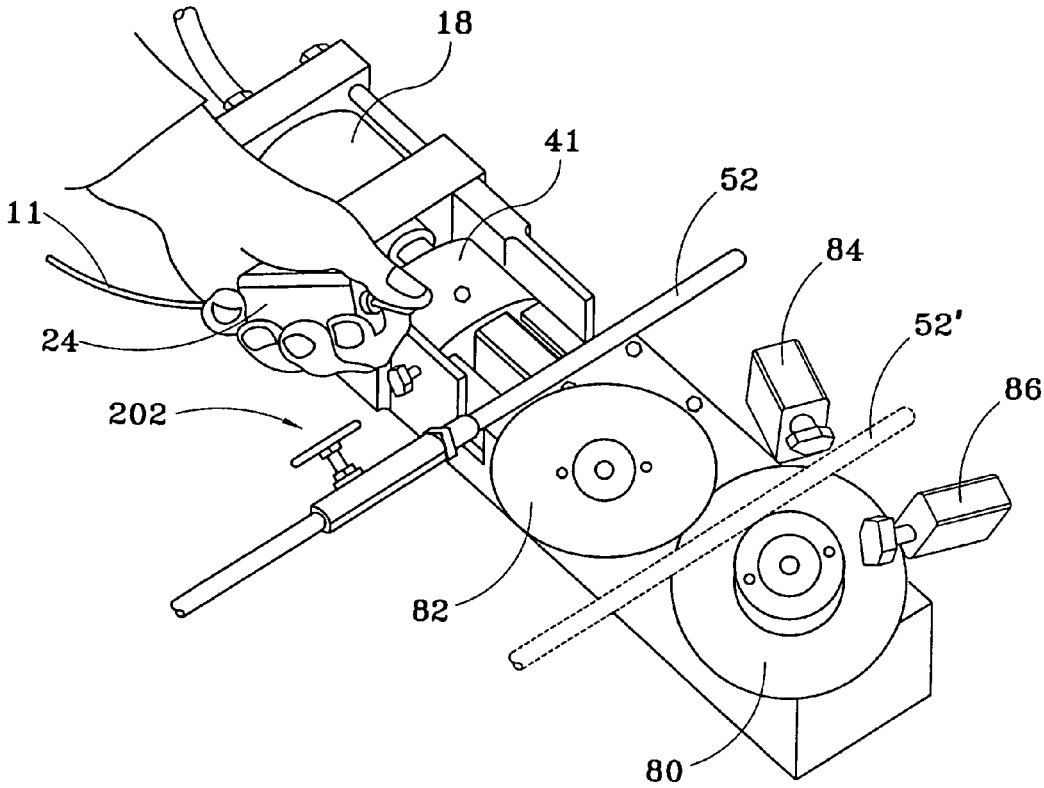
FIG. 14 is a top, perspective, partial view of the device, showing a peice of rebar inserted within the gap between the first and second wheels of the device, ready for bending.

With reference to FIGS. 11 and 12, the device further includes a length guage 200, comprising a first part 202 and a second part 204, for measuring a length of rebar to be cut or bent. The first part 202 has a first end formed as a nipple 202N adapted for insertion into either one of two holes 220 that are provided on the front side 122 adjacent the cutting region 50. The first part 202 has an opposite, second end 202R formed as a cylindrical recess adapted to receive in close-fitting engagement an end portion of a peice of rebar 52. Intermediate the first end 202N and the second end 202R is a manual turn screw clamp 202C fitted with a handle 202H such that by turning the handle 202H the inserted rebar 52 can be releasably clamped to the second part 202. The second part 204 comprises a hollow cylindrical tube 204T having a first end 206 and an opposite second end 208, a flat, vertical plate 204P extending upward from said second end 208 and a manual turn screw clamp 204C intermediate said first and second ends 206, 208 and fitted with a handle 204H. In use, the the first end 202N of the first part 202is inserted into a hole 220, a length of rebar 52 is inserted into the second end 202R thereof, and the screw clamp is 202C is tightened. The free end of the rebar 52 is inserted through the tube 204T and slid to a distance from the first side 122 equal to the desired length of the rebar to be cut, and the clamp 204C is tightened. With the shaft assembly in a r tracted position, the first part 202 is removed from the hole 220, and the rebar 52 is then moved across the device and through the gap G until the plate 204P is flush with an exterior surface of the first side 122. The device is energized, causing the shaft assembly 30 and the movable cutting head 44 to advance, forcing the rebar 52 against the fixed cutting head 46 and shear the rebar 52. The shaft assembly 30 is then moved back to the retracted position by reversing the direction of flow of hydraulic fluid via switch 25.

For bending rebar, with the shaft assembly 30 in a retracted psotion, a length of rebar 52' to be bent is set in the gap between the first wheel 80 and the second wheel 82, and the device is energized, causing the wheels 80, 82 to rotate and the rebar 52' to be bent as the bending blocks 84, 86 rotate with the driven wheel 80.

It will be appreciated that various modifications can be made to the exact form of the present invention without departing from the scope thereof. It is accordingly intended that the disclosure be taken as illustrative only and not limiting in scope, and that the scope of the invention be defined by the following claims.

I claim:

1. A device for cutting and bending rebar, comprising:

a longitudinally-extended main frame;

a shaft assembly connected to said main frame and movable along a first, longitudinal axis (A—A) between a first, retracted position and a second extended position and having a first end and an opposite, second end;

a first, movable cutting head carried by the shaft assembly and movable therewith along axis (A—A);

a second, fixed cutting head disposed such that the first cutting head is substantially adjacent to the second cutting head when the shaft assembly is in the extended position;

a crankshaft assembly disposed for pivotal rotation about a first rebar bending axis (B—B) substantially perpendicular to the first longitudinal axis (A—A) in response to longitudinal movements of the shaft assembly;

means attached to the shaft assembly for coupling the shaft assembly to the crankshaft assembly;

a first, driven rebar bending wheel mounted on the crankshaft assembly for rotation about the first rebar bending axis (B—B);

a second, idler rebar bending wheel longitudinally spaced-apart from the first wheel and rotatable about a second rebar bending axis (B'—B') that is parallel to the first rebar bending axis (B—B), the space between the first and second wheels defining a gap that is wide enough for insertion of a piece of rebar that is to be bended but narrow enough that the peripheral edges of the first and second wheels will be in frictional engagement with the inserted rebar;

a first bending block attached to, and rotatable with, the first wheel for bending into a first arc a piece of rebar inserted between the first and second wheels; and linear actuator means attached to the main frame and in driving engagement with the first end of the shaft assembly for reciprocal movement of said assembly along the first, longitudinal axis (A—A);

whereby, in a first mode of operation, as the shaft assembly moves from the retracted position to the extended position, a piece of rebar inserted laterally between the first and second cutting heads will be sheared by the cutting heads, and, in a second mode of operation, as the shaft assembly moves from the retracted to the extended position, a piece of rebar inserted laterally between the first and second wheels will be moved laterally through the gap, engaged by said stop means, and bent in the direction of rotation of the first wheel to form a first arc.

2. The device of claim 1, further comprising a second bending block attached to, and rotatable with, the first wheel and circumferentially spaced-apart therefrom, for bending into a second arc a piece of rebar inserted laterally between the first and second wheels.

3. The device of claim 2, wherein the linear actuator means includes a hydraulic drive system, said system including a double-acting, single rod, hydraulic cylinder, said rod being in driving engagement with the first end of the shaft assembly.

4. The device of claim 3, wherein the shaft assembly includes a shaft having a first end and a second, opposite end, said first end being attached to the rod of said hydraulic cylinder;

a cutting head carriage attached to said second end of the shaft and carrying said first cutting head, and guide means attached to the main frame and longitudinally disposed on, and in sliding engagement with, opposite sides of the carriage to prevent lateral motion of the shaft assembly.

5. The device of claim 4, wherein the means for coupling the shaft assembly to the crankshaft assembly includes a push rod disposed for movement along a second longitudinal axis (C—C) substantially parallel to the first longitudinal axis (A—A), said push rod having a first end attached to the carriage and an opposite, apertured, second end;

a clevis having two longitudinally-directed, laterally spaced-apart, apertured ears joined by a laterally-disposed base, said base having a bore for receiving the second end of the push rod;

a longitudinally-disposed link having a first, apertured end inserted between the ears of the clevis and an opposite, second end pivotally attached to the crankshaft assembly; and a clevis pin inserted through apertures in the clevis ears and the aperture in the second end of the pushrod;

whereby longitudinal movements of the shaft assembly cause pivotal movements of the crankshaft assembly.

6. The device of claim 5, wherein the second end of the link has an opening and the crankshaft assembly includes a crankshaft aligned on the first rebar bending axis (B—B) and having an upper, relatively small diameter, cylindrical portion and a lower, relatively large diameter, cylindrical portion coaxial with the upper portion, the junction of said upper and lower portions defining a shoulder;

a crank having a first, upper end and a second, lower end joined by an intermediate neck portion, said upper end of said crank being attached to, and eccentrically-disposed with respect to, the lower portion of the crankshaft;

a crankshaft support leg coaxial with and extending away from the crankshaft, said leg being attached to said second end of said crank;

means for attaching the crank to the crankshaft;

means for attaching the crank to the crankshaft support leg;

and wherein further said neck portion of said crank is inserted through said opening in said second end of said link.

7. The device of claim 6, wherein the means for attaching the crank to the crankshaft includes a first crankshaft pin press fitted through a first set of aligned apertures in an upper end of the crank and in the lower end of the crankshaft and a second crankshaft pin press fitted through a second set of aligned apertures in the crank and in the crankshaft support leg, and said means further includes plug welds in said first and second set of aligned apertures and welds attaching said crank to the crankshaft and to the leg.

8. A device for cutting and bending rebar, comprising:

a longitudinally-elongated main frame, said main frame including two laterally spaced-apart, vertical sides, each side having a first end, an opposite, second end, and a rebar receiving slot intermediate the first and second ends, a laterally-disposed cylinder head having a longitudinally-directed cylinder head bore, said cylinder head joining the first and second ends of said sides, a laterally-disposed bulkhead intermediate the rebar receiving slot and the second ends of the sides and joining said sides, first and second, longitudinally-spaced apart wheel blocks mounted between upper portions of the sides, and a lower crankshaft support block mounted between lower portions of the sides;

a double-acting, single rod, hydraulic cylinder, mounted on the cylinder head with the rod thereof inserted through the cylinder head bore;

a shaft assembly movable along a first longitudinal axis (A—A) between a first, retracted position and a second extended position and having a first end attached to said rod and an opposite, second end;

a first, movable cutting head carried by the shaft assembly and movable therewith along the first longitudinal axis (A—A);

a second, fixed cutting head attached to the main frame and disposed such that the first cutting head is substantially adjacent to the second cutting head when the shaft assembly is in the extended position;

a crankshaft assembly mounted between lower crankshaft support block and the first wheel block for pivotal rotation about a first rebar bending axis (B—B) that is substantially perpendicular to the first longitudinal axis (A—A) in response to longitudinal movements of the shaft assembly;

a first, driven rebar bending wheel mounted on the crankshaft assembly for rotation about the first rebar bending axis (B—B);

a second, idler rebar bending wheel longitudinally spaced-apart from the first wheel and pivotally mounted to the second wheel block for rotation about a second rebar bending axis (B'—B') that is parallel to the first rebar bending axis (B—B), the space between the first and second wheels defining a gap that is wide enough for insertion of a piece of rebar that is to be bended but narrow enough that the peripheral edges of the first and second wheels will be in frictional engagement with the inserted rebar;

means attached to the shaft assembly for coupling the shaft assembly to the crankshaft assembly;

a first bending block attached to, and rotatable with the first wheel for bending into a first arc a piece of rebar inserted between the first and second wheels; and linear actuator means in driving engagement with the first end of the shaft assembly for reciprocal movement of said assembly along the first longitudinal axis (A—A);

whereby, in a first mode of operation, as the shaft assembly moves from the retracted position to the extended position, a piece of rebar inserted into the slot laterally between the first and second cutting heads will be sheared by the cutting heads, and, in a second mode of operation, as the shaft assembly moves from the retracted to the extended position, a piece of rebar inserted laterally between the first and second wheels will be bent in the direction of rotation of the first wheel.

9. The device of claim 8, wherein the bulkhead has a longitudinally-directed bulkhead bore, the second wheel is mounted for rotation on an idler shaft that is journalled within the second wheel block, the crankshaft assembly includes a crankshaft aligned on axis (A—A) and a cylindrical crank joined to the crankshaft, disposed parallel to the crankshaft, and offset therefrom, and said crankshaft assembly further includes a crankshaft support leg that is collinear with the crankshaft, said leg resting on a crankshaft bearing mount formed within the lower crankshaft support block, and wherein the means for coupling the shaft assembly to the crankshaft assembly includes a push rod disposed for movement within the bulkhead bore along a second longitudinal axis (C—C) substantially parallel to the first longitudinal axis (A—A), said rod having a first end attached to the carriage and an opposite, apertured, second end;

a clevis having two longitudinally-directed, laterally spaced-apart, apertured ears joined by a laterally-disposed base, said base having a bore that receives the second end of the push rod;

a longitudinally-disposed link having a first, apertured end inserted between the ears of the clevis and an opposite, second end pivotally attached to the crankshaft assembly; and a clevis pin inserted through apertures in the clevis ears and the aperture in the second end of the push rod;

whereby longitudinal movements of the shaft assembly between the retracted and extended positions cause corresponding longitudinal movements of the first end of the push rod and, consequently, pivotal movements of the crankshaft and of the first wheel about axis (B—B).

10. The device of claim 9, wherein the main frame further includes a horizontal bottom plate that joins and extends between lower portions of the sides and underlies the lower crankshaft support block; and a horizontal top plate that extends from the second ends of the sides to the bulkhead and joins upper portions of said sides, said top plate having a first opening through which extends an upper portion of the crankshaft and a second opening through which extends an idler shaft.

11. The device of claim 10, further comprising at least one rebar measuring gauge, means for attaching said gauge to the main frame adjacent the slot, and means for attaching said gauge to the main frame adjacent the gap between the first and second wheels.

12. The device of claim 11, further comprising a second bending block attached to, and rotatable with, the first wheel and circumferentially spaced-apart therefrom, for bending into a second arc a piece of rebar inserted laterally between the first and second wheels.

* * * * *